US007796145B2

(12) United States Patent
Almog et al.

(10) Patent No.: US 7,796,145 B2
(45) Date of Patent: Sep. 14, 2010

(54) HYBRID ELECTRO-PHOTOGRAPHIC/INK-JET PRESS PRINT SYSTEMS AND PRIMERS

(75) Inventors: Yaacov Almog, Nes Ziona (IL); Ehud Chatow, Palo Alto, CA (US); Clayton L. Holstun, San Marcos, CA (US); Christian Schmid, Rancho Bernardo, CA (US); Sergio Brandriss, Rehovot (IL); Ronald A. Askeland, San Diego, CA (US); David S. Vejtasa, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 539 days.

(21) Appl. No.: 11/786,408

(22) Filed: Apr. 11, 2007

(65) Prior Publication Data

US 2008/0252680 A1 Oct. 16, 2008

(51) Int. Cl.
*B41J 2/435* (2006.01)

(52) U.S. Cl. ..... 347/111

(58) Field of Classification Search ..... 347/111, 347/2, 3, 4

See application file for complete search history.

(56) References Cited

U.S. PATENT DOCUMENTS

| | | | | |
|---|---|---|---|---|
| 5,140,674 | A * | 8/1992 | Anderson et al. | 358/1.12 |
| 6,174,936 | B1 | 1/2001 | Kato | |
| 6,410,200 | B1 | 6/2002 | Williams | |
| 6,655,275 | B2 * | 12/2003 | Mugrauer | 101/228 |

FOREIGN PATENT DOCUMENTS

| | | |
|---|---|---|
| JP | 08258269 | 10/1996 |
| JP | 12221789 | 8/2000 |

* cited by examiner

*Primary Examiner*—Huan H Tran

(57) ABSTRACT

Electro-photographic press print systems, methods of disposing a fluid onto a substrate in an electro-photographic press print system, and electro-photographic ink primers, are disclosed.

79 Claims, 4 Drawing Sheets

14

32

34

18

52

54

HYBRID ELECTRO-PHOTOGRAPHIC/INK-JET PRESS PRINT SYSTEMS AND PRIMERS

BACKGROUND

One of the opportunities of printing on digital presses using electro-photographic printing technologies is the wide substrate range that can be made compatible with the press. However, some of the commonly used media in commercial printing or industrial printing have low affinity to ink (e.g., ElectroInk™) used in LEP (Liquid Electro Photography) printing. The reflection of the low affinity is seen in the relatively low durability of the ink on the paper. Peeling and abrasion threshold levels are not satisfactory and finishing steps on the printed papers as well as normal handling can adversely affect the print quality. One solution to this problem is made via an off-line pre-print treatment of the paper with a primer. Another solution to this problem is made via a post-print treatment of the paper with an overcoat. However, treating the paper using any type of pre- or post-print treatment increases costs and the complexity of the process.

SUMMARY

Briefly described, embodiments of this disclosure includes electro-photographic press print systems, methods of disposing a fluid onto a substrate in an electro-photographic press print system, and electro-photographic ink primers, are disclosed.

One exemplary embodiment of electro-photographic press print system, among others, includes: a pre-print ink-jet system that includes at least one ink-jet printhead, wherein the ink-jet printhead includes a first fluid; and an electro-photographic press engine positioned after the pre-print ink-jet system.

One exemplary embodiment of a method of disposing a fluid onto a substrate in an electro-photographic press print system, among others, includes: providing a substrate; feeding the substrate into a pre-print ink-jet system; disposing a first fluid onto the substrate; feeding the substrate into an electro-photographic press print engine; and printing onto the substrate using the electro-photographic press print engine.

One exemplary embodiment of an electro-photographic ink primer, among others, includes: an adhesion promoting compound, wherein the adhesion promoter compounds is a polymeric compound; and a solvent, wherein the primer has a pH of about 7 to 10.

BRIEF DESCRIPTION OF THE DRAWINGS

Many aspects of this disclosure can be better understood with reference to the following drawings. The components in the drawings are not necessarily to scale. Moreover, in the drawings, like reference numerals designate corresponding parts throughout the several views.

DETAILED DESCRIPTION

Figure 1:
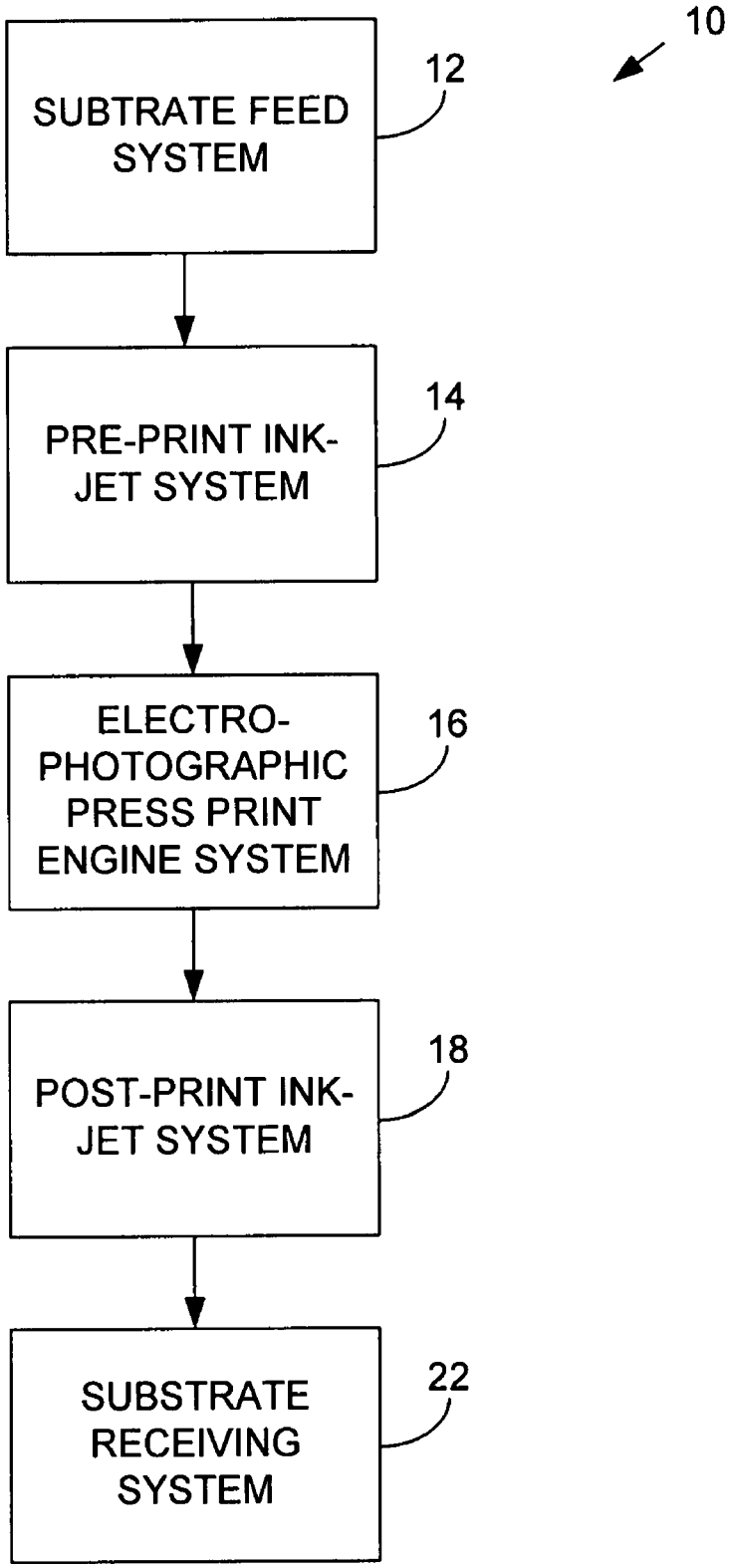
FIG. 1 illustrates a block diagram of an exemplary embodiment of the electro-photographic press print system.

Embodiments of the present disclosure will employ, unless otherwise indicated, techniques of synthetic organic chemistry, ink chemistry, media chemistry, printing chemistry, and the like, that are within the skill of the art. Such techniques are explained fully in the literature.

The following examples are put forth so as to provide those of ordinary skill in the art with a complete disclosure and description of how to perform the methods and use the compositions disclosed and claimed herein. Efforts have been made to ensure accuracy with respect to numbers (e.g., amounts, temperature, etc.) but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an" and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Discussion

Electro-photographic press print systems including ink-jet print systems for disposing fluids onto a substrate are provided. In addition, primers for disposing onto the substrate are provided. The electro-photographic press print system includes a pre-print ink-jet print system disposed in the substrate feed path between the substrate (e.g., paper) feeding system (e.g., sheet or web feeding systems) and the electro-photographic press print engine (e.g., dry or liquid electro-photographic press print engines). The pre-print ink-jet print system is configured to dispose a fluid (e.g., a primer) onto particular portions (e.g., digital format overlapping of printed portions only) of a substrate or onto the entire substrate. In an embodiment, the electro-photographic press print system includes a post-print ink-jet print system positioned after the electro-photographic press print engine. The post-print ink-jet print system is configured to dispose a fluid (e.g., a varnish and/or an overcoat) onto particular portions of a substrate or onto the entire substrate after the electro-photographic press print engine has printed onto the substrate.

Embodiments of the present disclosure are advantageous because the ink-jet print systems can be used to dispose fluids onto the substrates (both pre-print and post print) that would otherwise be performed off line, which increases time to print and cost expenses. In addition, these types of off-line coating operations typically apply fluid over the entire surface of the substrate only, at a single level, and at a single concentration of active ingredient.

In addition, using the ink-jet print system (pre-print and post print) permits printing on a wide range of substrates types (e.g., coated and un-coated substrates) substrate widths, and substrate thickness with low cost and high flexibility.

The ink-jet print system (pre-print and post print) allows the placement of the fluid using a non-contact method that can accurately and precisely dispose the fluid onto one or more positions on the substrate. The ink-jet print system allows the user to tune the amount of fluid disposed onto the substrate, which is advantageous for at least the following reasons. Since each electro-photographic substrate type is different, the ability to tune allows better control of the printing process based on variables relevant to each particular electro-photographic substrate type. Being able to limit the amount of fluid disposed on the substrate decreases the expense associated with the cost of the fluid since less fluid is used and decreases the expense associated with drying the substrate after the fluid is disposed on the substrate. Another advantage of tuning the amount of fluid deposited occurs when multiple types of substrates are used and each substrate requires different amounts or types of fluid to be disposed on the particular substrate.

Another advantage is that different levels of fluid (different grams per square meter (GSM) amounts) can be disposed on one or both sides of the substrate by choosing to print different grey level patterns. For example, by simply varying the grey level pattern you are printing, the amount of fluid disposed of the substrate can be changed. In other words, a 30% grey level pattern can be selected and 3 GSM of the fluid would be disposed on the substrate (e.g., an uncoated paper), while a 10% grey level pattern can be selected and 1 GSM of fluid would be disposed on the substrate (e.g., a coated paper).

When different substrate widths are printed, a simple change in the ink-jet print system (pre-print and post print) can be made so that the full page is primed, but there is no over-spray waste. With conventional types of primer systems (e.g., rollers) unused primer fluid in regions beyond the width of the media can accumulate contaminants and paper dust, and can accumulate on rollers, requiring frequent cleaning and maintenance.

Also, since the ink-jet print system (pre-print and post print) is completely non-contact, substrates of different thicknesses can be accommodated with no change in the system. Conventional types of primer systems (e.g., rollers) would require careful adjustment for each change in substrate thickness. Also, non-contact systems do not need to be carefully aligned to the substrate feeding system, which increases reliability and decreases start-up time.

The fluid delivery systems in the inkjet systems (pre-print and post print) also tend to be closed, and non-recirculating. With conventional roller systems, the fluid is exposed to the air so evaporation and oxidation can change the properties of the fluid. These kinds of re-circulating systems also much more vulnerable to contamination. If the fluid chemistry is reactive, such as with a UV cured overcoat, any fluid not coated onto the substrate is not only wasted, but also becomes a waste stream that must be discarded. With an ink-jet print system, the fluid is only applied on the substrate so there is little or no waste.

Another embodiment of the present disclosure includes applying the fluid in a pattern that matches the pattern the will be deposited by the electro-photographic printing system. Applying priming fluid only where it is needed advantages such as, but not limited to: lower cost, since less primer is used; lower levels of energy needed to adequately dry the primer; no chance of the primer itself being visible, since it is always covered by the electro-photographic toner; no chance for the primer to create a visible change in appearance of the substrate, since it is always covered by the electro-photographic toner; less potential for damage to the electro-photographic system components (since the primer is only applied where ink will also be applied, there is little chance for the primer fluid to build up on the electro-photographic system components); un-primed regions can be intentionally created so that pre-print primer chemistry does not interfere with post-printing overcoat chemistry; and/or un-printed or low-level printed regions can be intentionally created so that a controlled level of local adhesion of ink onto the paper can be produced (the production of such controlled adhesion can be very useful in lottery tickets like applications).

As mentioned above, a pre-print ink-jet print system can be positioned in the substrate feed path between the substrate feed system and the electro-photographic press print engine system (described in more detail below). The pre-print ink-jet print system can be used to dispose a fluid onto a portion of the substrate or the entire substrate prior to being acted upon by the electro-photographic press print engine system.

The fluid can include, but is not limited to, a primer, a surface roughness leveler, and an overcoat varnish, at various concentrations of the active ingredients. The overcoat varnish can include, but is not limited to, ultraviolet varnishes (e.g., a coating weight of about 5 to 8 gsm, Nicoat UVF 63Id (Nicoat Bensenville Il., USA), Wessco 3032 (Schmidt-rhyner, Switzerland), EXCure 90004 (Arets, Niel, Belgium), EXCure 10705 (Arets, Niel, Belgium), UltraSheen 9020 (Kelstar, Cinnaminson N.J., USA), Ultrasheen 9790 (Kelstar, Cinnaminson N.J., USA), where the viscosity can be adjusted using heat and/or dilution)), water-based varnishes (e.g., a coating weight of about 3 to 6 gsm, OPV 060-7544-15.20EN (SICPA Lausanne, Switzerland), OPV 060-7547-00.202EN (SICPA Lausanne, Switzerland), where the viscosity can be adjusted using heat and/or dilution with water), waxes (e.g., a coating weight of about 3 to 5 gsm, ME 43040, ME 91240, and ME 98040M1 (each of Michelman), where the viscosity can be adjusted using dilution with water), silicone water-based emulsions (e.g., a coating weight of about 1 to 3 gsm, Web Protect S18080 (Fuji Hunt)), and combinations thereof.

The primer of the present disclosure is advantageous in that it provides excellent liquid electro-photographic (LEP) ink adhesion on various media. In addition, the primer is reliably ejected from ink-jet print heads causes little or no clogs in the nozzles. Furthermore, the primer penetrates and spreads quickly into media, enabling superior dry-time and maximizing fluidic efficiency.

The primer includes an adhesion promoting compound. Adhesion promoting compounds are polymeric in nature. The polymer can include, but is not limited to, a polyethylenimine polymer (e.g., having a weight-averaged molecular weight of about 25,000 to 700,000), polyethylene-co-acrylic acid polymer (ammonium salt) (e.g., having a molecular weight of about 10,000 to 30,000), thermoplastic polyamide, amine terminated polyamide, methylated polyethylenimine polymer, and combinations thereof. In an embodiment, the polyethylenimine polymer has a molecular weight of about 25,000 or 700,000. The polymer can be about 1 to 25, about 2 to 10 and about 2.5 to 5 weight percent of the primer. In general, having greater weight percent of polymer in the primer fluid is advantageous for adhesion. In an embodiment, the polyethlylenimine is about 2.5 to 5% weight percent of the primer.

In addition, the primer fluid can include a water-miscible co-solvent, used primarily to facilitate its ejection from ink-jet print heads, many of which are known in the art. In particular, solvents that belong to the class of "linear alcohols"

can be included in the primer fluid. In particular, alkane-diols and -triols are preferable, and specifically, those with the hydroxyl groups present at or near only one end of the molecule, give advantageous performance. Some examples include, but are not limited to: 1,2-butanediol, 1,2-pentanediol, 1,2-hexanediol, 1,2,3-hexanetriol, 1,2-heptanediol, and 1,2-octanediol. Although not intending to be bound by theory, it is believed that such solvents are amphiphilic in nature, i.e. they have a hydrophobic end and a hydrophilic end. This amphiphilic nature allows the solvent to wet hydrophobic surfaces well, and thus penetrate and spread rapidly on paper. In particular, an embodiment of the solvent includes 1,2-hexanediol. The "solvent" can be about 0 to 40, about 2 to 20, and about 4 to 10 weight percent of the primer.

In particular, the primer can include, but is not limited to, Sapphire™, Topaz™, Digiprime™, Emicote™, and Curecoat.

Also, the primer can include, but is not limited to, a surfactant and water. The surfactant can include, but is not limited to, anionic surfactants, non-ionic surfactants, zwitterionic surfactants, cationic surfactants, and the like. In an embodiment, nonionic acetylenic glycol surfactants with HLB (hydrophile-lipophile balance) of 4-5 can be used. The surfactant can be about 0 to 5, about 0.1 to 1 and about 0.2 to 0.5 weight percent of the primer. Water constitutes the balance of the weight percent of the primer.

The primer has a pH of about 4 to 11, about 7 to 10, and about 8 to 9.5. The pH of the primer can be adjusted down by a mono-protic strong acid (e.g., hydrochloric acid, nitric acid, or methanesulfonic acid). Conversely, the pH of the primer fluid can be adjusted up by a strong base (e.g., sodium hydroxide and potassium hydroxide). The pH adjuster can be added at anytime during preparation of the primer.

The amount of primer disposed on the substrate can be about 0.1 gsm to 10 gsm, about 1 gsm to 5 gsm, and about 1.5 gsm to 3 gsm.

In an embodiment, the primer fluid contains either about 2-8% of a polyethylenimine having a molecular weight of about 25,000 (Lupasol WF) or about 2-5% a polyethylenimine having a molecular weight of about 700,000 (Lupasol P), along with about 3-30% of 1,2-hexanediol, and about 0-5% of one or more surfactants (e.g., Surfynol SE-F from Air Products), at a pH range of about 7-10. This primer fluid provides excellent liquid electro-photographic ink adhesion on various media, is reliably ejected from ink-jet print heads, and penetrates and spreads quickly into media, enabling superior dry-time and maximizing fluidic efficiency.

In an embodiment, the pre-print ink-jet print system can include two or more concentrations of the same fluid. For instance, uncoated substrates generally need primer with higher concentrations of the active ingredient. Such high concentrations are wasteful and unnecessarily expensive with coated substrates. In another embodiment, the pre-print ink-jet print system can include two or more different fluids. For instance, one fluid could be designed for polymer based substrates and the other for paper based substrates.

The pre-print ink-jet print system (as well as the post-print ink-jet print system) includes, but is not limited to, a computer control system, a fluid supply system, and a fluid dispensing system. The computer control system includes a process control system that is operative to control the fluid dispensing system. In particular, the computer control system instructs and controls the fluid dispensing system to disposed one or more fluids on the substrate in various designs (e.g., characters, symbols, photos, and the like) or onto the entire substrate.

The fluid dispensing system includes, but is not limited to, ink-jet technologies that dispense one or more fluids onto the substrate. Ink-jet technology, such as drop-on-demand and continuous flow ink-jet technologies, can be used to dispense the ink. The fluid dispensing system can include at least one ink-jet printhead system (e.g., thermal ink-jet printhead and/or a piezo ink-jet print head) operative to dispense (e.g., jet) the fluid through one or more of a plurality of nozzles in a printhead. The printhead system incorporates an array of firing chambers that receive the fluid that is in fluid communication with one or more fluid reservoirs. In an embodiment, an ink-jet printhead includes at least two fluid reservoirs, each including a different type of fluid or the same fluid at different concentrations of the active ingredients.

In short, the following describes a non-limiting embodiment of a liquid electro-photographic press print engine system. It should be noted that a dry electro-photographic press print engine system could be used as well.

The electro-photographic press print engine system includes a drum that has a photoconductive surface. When the electro-photographic press print engine system is operated, a drum rotates and a photoconductive surface is charged by a charger (e.g., a corotron, a scorotron, or a roller) to a generally uniform pre-determined voltage. Rotation of the drum brings the charged photoconductive surface into image receiving relationship with an exposure system, such as a light source (e.g., laser beam scanning apparatus). The exposure system forms a desired electrostatic image on the charged photoconductive surface by selectively discharging portions of the photoconductive surface. The image portions are at a first voltage and the background portions are at a second voltage.

Continued rotation of drum brings the charged photoconductive surface, having the electrostatic image, into operative engagement with a series of developer rollers. The developer rollers are for printing of different colors. The surfaces of the developer rollers are coated with a very thin layer of concentrated liquid ink, or toner. When surfaces of developer rollers having the layer of liquid toner concentrate thereon are engaged with photoconductive surface of the drum, the difference in voltage between each developer roller and the photoconductive surface causes the selective transfer of the layer of toner particles to the photoconductive surface. This causes the desired electrostatic image to be developed on the photoconductive surface.

The electrostatic image developed is transferred to the desired substrate via an intermediate transfer member in operative engagement with photoconductive surface of the drum having the developed image. The substrate is urged against the intermediate transfer member. The transfer of the developed image from intermediate transfer member to the substrate is a thermal transfer and based on the affinity of the ink to the substrate versus the affinity to the blanket. The transfer could be assisted electrostatically.

As mentioned above, a post-print ink-jet print system can be positioned in the substrate feed path after the electro-photographic press print engine system prior to the substrate receiving system.

The post-print ink-jet print system can be used to dispose a fluid onto a portion of the substrate or the entire substrate after being printed on by the electro-photographic press print engine system. The fluid can include, but is not limited to, a water-based varnish, a UV cured varnish, an overcoat, a gloss enhancing layer, and a gloss leveling layer, each at various concentrations of the active ingredients. In an embodiment, the pre-print ink-jet print system can include two or more concentrations of the same fluid or two or more different fluids.

The substrate can include, but is not limited to, coated paper, un-coated paper, polymer based synthetic paper (e.g., Tyvex), label stock, polymer stock (e.g., polyethylene, polypropylene, polyester, PVC, polycarbonate). The substrate can have a wide range of thicknesses as well, without requiring any adjustment to the ink-jet printing system.

FIGS. 1 through 3 illustrate an exemplary embodiment of the electro-photographic press print system. FIG. 1 illustrates a block diagram of an embodiment of electro-photographic press print system 10 that includes, but is not limited to, a substrate feed system 12, a pre-print ink-jet system 14, an electro-photographic press print engine system 16, a post-print ink-jet system 18, and a substrate receiving system 22. Each of the systems noted above are in direct or indirect communication (e.g., substrate movement among the systems using a substrate feed path). An exemplary embodiment of the electro-photographic press print engine system 16 is described above.

For example, a substrate is passed from the substrate feed system 12 to the pre-print ink-jet system 14, where the substrate may be treated using the pre-print ink-jet system 14. Next, the substrate passes from the pre-print ink-jet system 14 to the electro-photographic press print system 16 (e.g., dry or liquid electro-photographic press print systems), where the electro-photographic press print system 16 prints onto the substrate. Subsequently, the substrate passes from the electro-photographic press print system 16 to the post-print ink-jet system 18, where the substrate may be treated using the post-print ink-jet system 18. Then, the substrate is passed from the post-print ink-jet system 18 to the substrate receiving system 22.

Figure 2A:
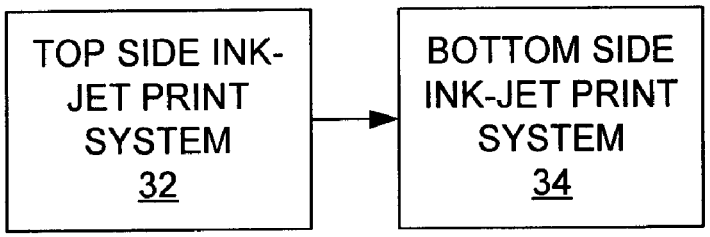
FIGS. 2A through 2C illustrate block diagrams of an exemplary embodiment of a pre-print ink-jet system.
Figure 2B:
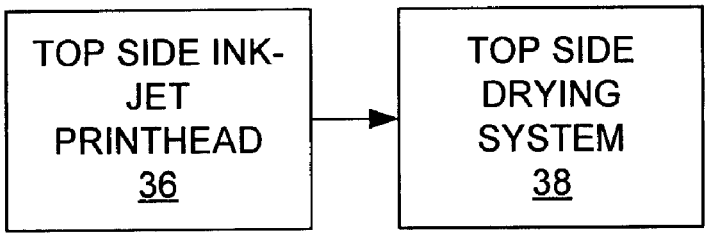
Figure 2C:
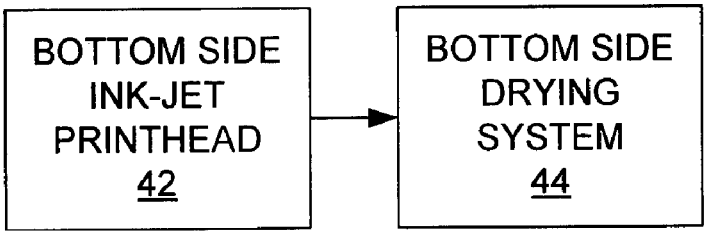

FIGS. 2A through 2C illustrate block diagrams that describe portions of the pre-print ink-jet system 14. FIG. 2A illustrates a block diagram of the pre-print ink-jet system 14. The pre-print ink-jet system 14 includes, but is not limited to, a top side ink-jet print system 32 and a bottom side ink-jet print system 34. FIG. 2B illustrates a block diagram of the top side ink-jet print system 32, where the top side ink-jet print system 32 includes, but is not limited to, a top side ink-jet printhead 36 and a top side drying system 38. FIG. 2C illustrates a block diagram of the bottom side ink-jet print system 34, where the bottom side ink-jet print system 34 includes, but is not limited to, a bottom side ink-jet printhead 42 and a bottom side drying system 44.

The top side ink-jet printhead 36 and the bottom side ink-jet print system 42 can each include one or more ink-jet printheads such as those described above. Each of the top side ink-jet printhead 36 and the bottom side ink-jet printhead 42 can include one or more fluids disposed in separate fluid reservoirs. For example, each of the top side ink-jet printhead 36 and the bottom side ink-jet print 42 can include a first primer in a first fluid reservoir and a second fluid in a second fluid reservoir (e.g., a different type of primer or the same primer at different concentrations of the active ingredients). The top side ink-jet printhead 36 and the bottom side ink-jet print system 42 provided a non-contact process for disposing the fluid onto the substrate precisely and accurately, which limits the amount of fluid used and the position on the substrate that the fluid is disposed on the substrate.

The top side drying system 38 and the bottom side drying system 44 can each include electric heaters, quartz radiant heaters, hot air blowers, moist air removal systems, and fluid spreading mechanisms. In short, each of the top side drying system 38 and the bottom side drying system 44 drying the substrate so that the substrate can enter the electro-photographic press print system 16 without damaging any of the electro-photographic press print system 16 components and to ensure that quality of the printing of the substrate.

Figure 3A:
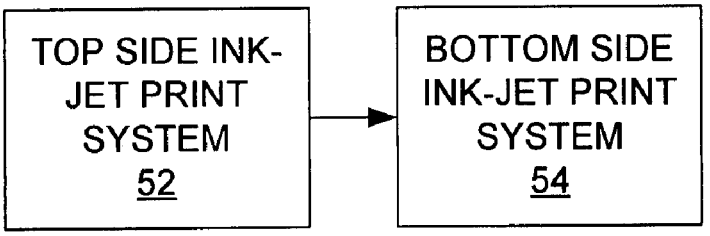
FIGS. 3A through 3C illustrate block diagrams of an exemplary embodiment of a post-print ink-jet system.
Figure 3B:
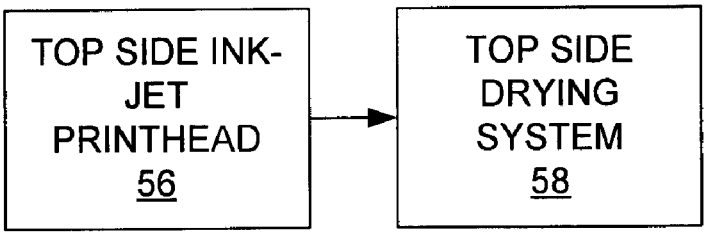
Figure 3C:
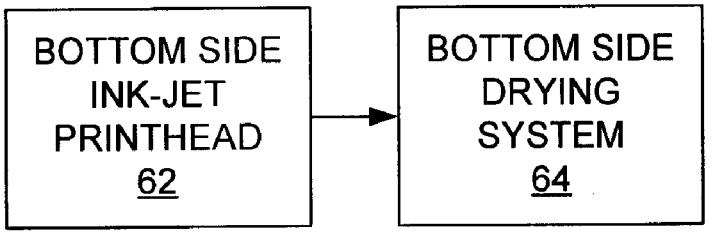

FIGS. 3A through 3C illustrate block diagrams that describe portions of the post-print ink-jet system 18. FIG. 3A illustrates a block diagram of the post-print ink-jet system 18. The post-print ink-jet system 18 includes, but is not limited to, a top side ink-jet print system 52 and a bottom side ink-jet print system 54. FIG. 3B illustrates a block diagram of the top side ink-jet print system 52, where the top side ink-jet print system 52 includes, but is not limited to, a top side ink-jet printhead 56 and a top side drying system 58. FIG. 3C illustrates a block diagram of the bottom side ink-jet print system 54, where the bottom side ink-jet print system 54 includes, but is not limited to, a bottom side ink-jet printhead 62 and a bottom side drying system 64.

The top side ink-jet printhead 56 and the bottom side ink-jet print system 62 can each include one or more ink-jet printheads such as those described above. Each of the top side ink-jet printhead 56 and the bottom side ink-jet print 62 can includes one or more fluids disposed in separate fluid reservoirs. For example, each of the top side ink-jet printhead 56 and the bottom side ink-jet print 62 can include a first overcoat in a first fluid reservoir and a second overcoat in a second fluid reservoir (e.g., a different type of overcoat or the same overcoat at different concentrations). The two fluid reservoirs can also contain the two components of a reactive chemistry type system (the A-part and the B-part). The top side ink-jet printhead 56 and the bottom side ink-jet print system 62 provided a non-contact process for disposing the fluid onto the substrate precisely and accurately, which limits the amount of fluid used and the position on the substrate that the fluid is disposed on the substrate.

The top side drying system 58 and the bottom side drying system 54 can each include electric heaters, quartz radiant heaters, hot air blowers, air removal systems, and ultraviolet curing mechanisms.

Figure 4:
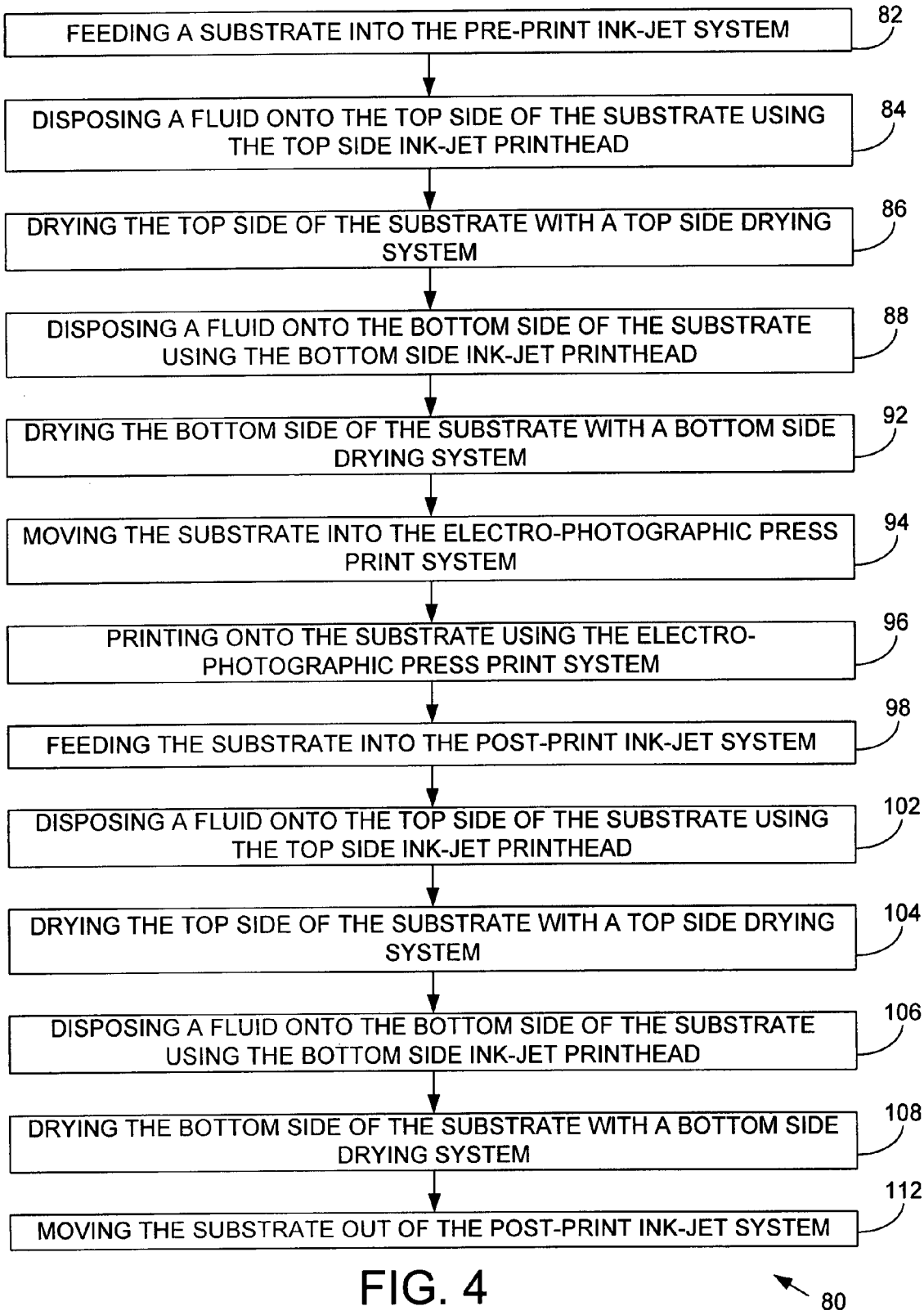
FIG. 4 is a flow chart of an embodiment of a method of disposing one or more fluids onto a substrate using the electro-photographic press print system described in FIG. 1.

FIG. 4 illustrates a representative flow chart describing an embodiment of a process 80 for using an embodiment of the electro-photographic press print system. Block 82 describes feeding a substrate into the pre-print ink-jet system. Block 84 describes disposing a fluid onto the top side of the substrate using the top side ink-jet printhead. Block 86 describes drying the top side of the substrate with a top side drying system. Block 88 describes disposing a fluid onto the bottom side of the substrate using the bottom side ink-jet printhead. Block 92 describes drying the bottom side of the substrate with a bottom side drying system. Block 94 describes moving the substrate into the electro-photographic press print system (e.g., dry or liquid electro-photographic press print systems). Block 96 describes printing onto the substrate using the electro-photographic press print system. Block 98 describes feeding the substrate into the post-print ink-jet system. Block 102 describes disposing a fluid onto the top side of the substrate using the top side ink-jet printhead. Block 104 describes drying the top side of the substrate with a top side drying system. Block 106 describes disposing a fluid onto the bottom side of the substrate using the bottom side ink-jet printhead. Block 108 describes drying the bottom side of the substrate with a bottom side drying system. Block 112 describes moving the substrate out of the post-print ink-jet system. It should be noted that another embodiment could include electro-photographic press print system that does not include a post-print ink-jet system, while including the pre-print ink-jet system. In another embodiment, the electro-photographic press print system does not include the pre-print ink-jet system, while including the post-print ink-jet system.

Figure 5:
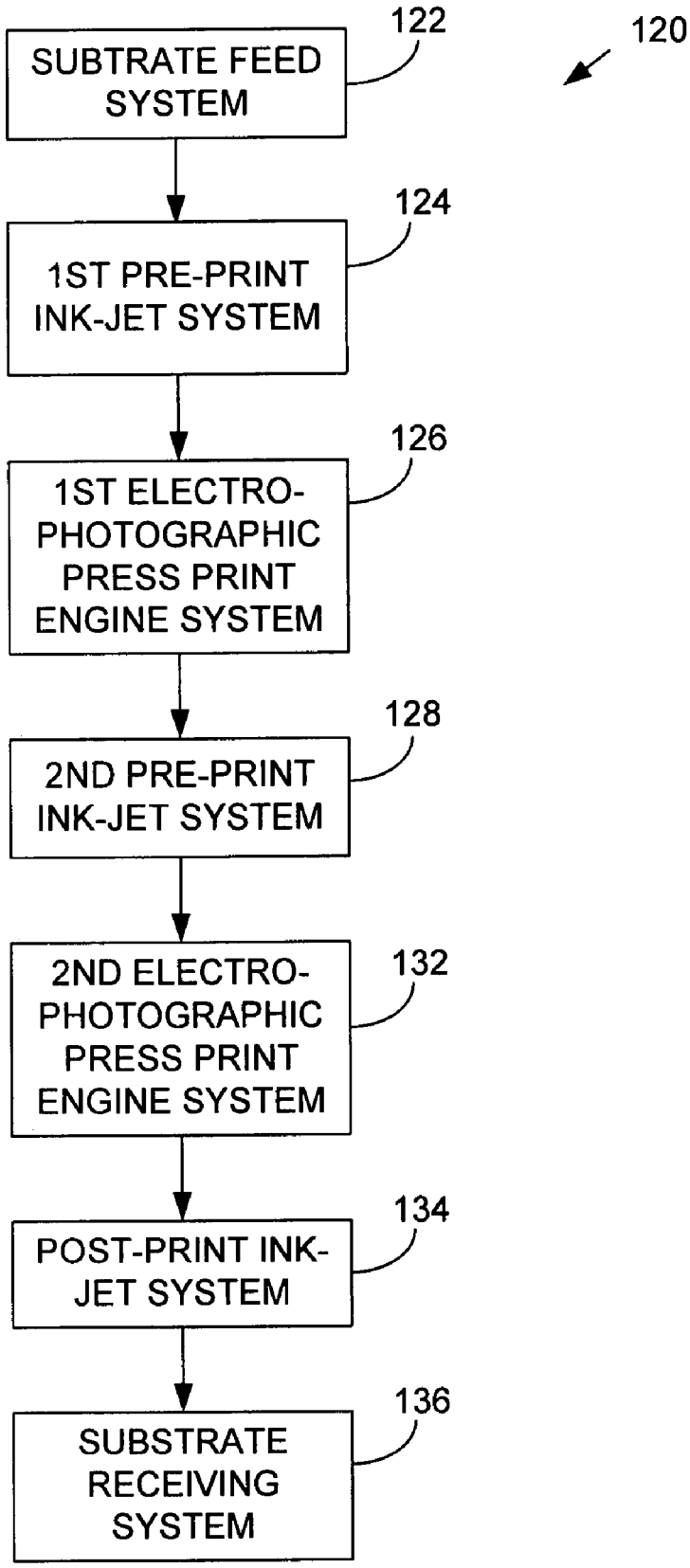
FIG. 5 illustrates a block diagram of an exemplary embodiment of the electro-photographic press print system including a multi-stage press and multiple priming stations.

FIG. 5 illustrates a block diagram of an embodiment of electro-photographic press print system 120 that includes, but is not limited to, a substrate feed system 122, a first pre-print ink-jet system 124, a first electro-photographic press print engine system 126, a second pre-print ink-jet system 128, a second electro-photographic press print engine system 132, a post-print ink-jet system 134, and a substrate receiving system 136. Each of the systems noted above are in direct or indirect communication (e.g., substrate movement among the systems using a substrate feed path). The first and second electro-photographic press print engine systems 126 and 132 are similar to the electro-photographic press print engine system described above. In addition, the first and second pre-print ink-jet systems 124 and 128 are similar to the pre-print ink-jet system described above. It should be noted that more than two electro-photographic press print engine system and corresponding pre-print ink-jet systems can be used. For example, four electro-photographic press print engine system can be used, each corresponding to one of the four colors.

For example, a substrate is passed from the substrate feed system 122 to the first pre-print ink-jet system 124, where the substrate may be treated using the first pre-print ink-jet system 124. Next, the substrate passes from the first pre-print ink-jet system 124 to the first electro-photographic press print system 126 (e.g., dry or liquid electro-photographic press print systems), where the first electro-photographic press print system 126 prints onto the substrate. Then the substrate is fed to the second pre-print ink-jet system 128, where the substrate may be treated using the second pre-print ink-jet system 128. In an embodiment, the second treatment can be performed on different portions of the substrate than were printed on by the first electro-photographic press print system or the treatment can be performed on portions of the substrate that have already been printed upon. This kind of secondary treatment can produce differential ink adhesion or a barrier layer, allowing one printed image to lie beneath a second printed image. In another embodiment, a transfer bar or other system can be used to turn the substrate over after the first electro-photographic press print system so that the second side of the substrate is treated by the second pre-print ink-jet system.

Next, the substrate passes from the second pre-print ink-jet system 128 to the second electro-photographic press print system 132 (e.g., dry or liquid electro-photographic press print systems), where the second electro-photographic press print system 132 prints onto the substrate. Subsequently, the substrate passes from the second electro-photographic press print system 132 to the post-print ink-jet system 134, where the substrate may be treated using the post-print ink-jet system 134. Then, the substrate is passed from the post-print ink-jet system 134 to the substrate receiving system 136. It should be noted that another embodiment could include electro-photographic press print system that does not include a post-print ink-jet system, while including one or more pre-print ink-jet systems. In another embodiment, the electro-photographic press print system does not include the pre-print ink-jet system, while including the post-print ink-jet system.

In this configuration, each pre-print ink-jet system would prime the media only in regions that had not already been primed, and are about to be printed in the upcoming electro-photographic print engine. For instance, if the first color printed is yellow, the first pre-print ink-jet system would only prime where yellow ink is going to be printed. If the second color is magenta, the second pre-print ink-jet system would only prime where magenta was going to be printed, but it would not prime any regions that had already been primed by the first primer. This process would continue for all color planes. With this type of multi-station electro-photographic print system, a single post-print primer is used.

While both top side and bottom side printing and drying functions have been discussed in reference to the figures above, another embodiment can include a single sided system (a single pre-print ink-jet system). In this embodiment, the substrate would be inverted after its first pass through the system and then fed through again. This substrate inversion could take place after the ink-jet printing and drying but before the electro-photographic printing station, or after both the ink-jet printing and drying and the electro-photographic printing station.

While embodiments of the present disclosure are described in connection with the Examples and the corresponding text and figures, there is no intent to limit the disclosure to the embodiments in these descriptions. On the contrary, the intent is to cover all alternatives, modifications, and equivalents included within the spirit and scope of embodiments of the present disclosure.

EXAMPLE 1

Exemplary Primer Fluid Compositions

Primer Fluid A
10% 1,2-hexanediol
0.5% Surfynol SEF
5% Lupasol WF (polyethylenimine, Mw=25,000)
balance: DI water
pH=9.0
Primer Fluid B
10% 1,2-hexanediol
0.3% Surfynol SEF
2.5% Lupasol P (polyethylenimine, Mw=700,000)
Balance: DI water
pH=9.0

Example B shows ease of application of primers from Example A with thermal ink-jet printhead and their improvements to LEP ink adhesion.

All primer fluids described in the table below contain 10% 1,2-hexanediol, 0.3% Surfynol SEF, balance water, at pH=9. In addition, each contains a quantity of polymer, as described in column #1 below:

TABLE 1

| polymer | spits to achieve good nozzle health after 6 sec decap | % OD remaining after tape peel (Cougar media, 2.4 gsm primer fluid) | % OD remaining after tape peel (Lustro media, 2.4 gsm primer fluid) |
|---|---|---|---|
| 8% Lupasol WF | 9 | 83% | 100% |
| 5% Lupasol WF | 1.5 | 82% | 100% |
| 2.5% Lupasol WF | 1 | 67% | 93% |
| 8% Lupasol P | >10 | X | X |
| 5% Lupasol P | >10 | 77% | 99% |
| 2.5% Lupasol P | 1.5 | 80% | 100% |

"X" indicates that the printing was not done well enough to measure adhesion

In the above table, column #2 ('spits to achieve good nozzle health') is a measure of the ease of ejection of the various primer fluids from an ink-jet pen. This measurement is made by exposing inactive inkjet print head nozzles to the atmosphere for 6 seconds, and then firing all nozzles repeatedly until the majority appear to be firing properly. It is desirable that this number be as low as possible (1 is perfect), meaning that the ink is readily fired from an ink-jet pen, even after a 6 second period of inactivity. As is seen above, primers with 5% Lupasol WF and 2.5% Lupasol P give excellent performance.

In the table above, columns #3 and #4 refer to the amount of colorant present on an LEP print sample, after peeling a piece of tape from that sample. So higher numbers here are desirable, 100% is perfect, meaning that the print was not at all damaged by the tape. As can be seen above, again primers with 5% Lupasol WF and 2.5% Lupasol P give an optimal balance of 'ease-of-ejection' and LEP ink adhesion improvement.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. In addition, the phrase "about 'x' to 'y'" includes "about 'x' to about 'y'".

Many variations and modifications may be made to the above-described embodiments. All such modifications and variations are intended to be included herein within the scope of this disclosure and protected by the following claims.

At least the following is claimed:

1. An electro-photographic press print system, comprising:

a pre-print ink-jet system that includes at least one ink-jet printhead, wherein the ink-jet printhead includes a first fluid;

an electro-photographic press engine positioned after the pre-print ink-jet system; and a post-print ink-jet system positioned after the electro-photographic press engine, wherein the post-print ink-jet system includes at least one ink-jet printhead that includes a second fluid.

2. The electro-photographic press print system of claim 1, wherein the first fluid includes a primer.

3. The electro-photographic press print system of claim 1, wherein the second fluid is selected from a varnish solution and an overcoat solution.

4. The electro-photographic press print system of claim 1, wherein the pre-print ink-jet system includes a first ink-jet printhead for disposing the first fluid on a first side of a substrate, and a second ink-jet printhead for disposing the first fluid on a second side of the substrate.

5. The electro-photographic press print system of claim 4, wherein the first ink-jet printhead includes a second fluid, wherein the second fluid and the first fluid are different fluids.

6. The electro-photographic press print system of claim 4, wherein the first ink-jet printhead includes a second fluid, wherein the second fluid and the first fluid are the same type of fluids, and wherein the second fluid and the first fluid are at different concentrations.

7. The electro-photographic press print system of claim 4, wherein pre-print ink-jet system includes a first drying system positioned after the first ink-jet printhead for drying the first side of the substrate, and a second drying system positioned after the second ink-jet printhead for drying the second fluid on the second side of the substrate.

8. The electro-photographic press print system of claim 7, wherein post-print ink-jet system includes a first drying system positioned after the first ink-jet printhead for drying the first side of the substrate, and a second drying system positioned after the second ink-jet printhead for drying the second fluid on the second side of the substrate.

9. The electro-photographic press print system of claim 4, wherein the first ink-jet printhead includes a first primer solution and a second primer solution in separate compartments, wherein the second ink-jet printhead includes the first primer solution and the second primer solution in separate compartments, wherein the first primer solution has a first concentration and the second primer has a second concentration, wherein the first concentration and the second concentration are different.

10. The electro-photographic press print system of claim 1, wherein post-print ink-jet system includes a first ink-jet printhead for disposing the third fluid on a first side of a substrate, and a second ink-jet printhead for disposing the third fluid on a second side of the substrate.

11. The electro-photographic press print system of claim 10, wherein the first ink-jet printhead includes a fourth fluid, wherein the third fluid and the fourth fluid are different fluids.

12. The electro-photographic press print system of claim 10, wherein the first ink-jet printhead includes a fourth fluid, wherein the third fluid and the fourth fluid are the same type of fluids, and wherein the third fluid and the fourth fluid are at different concentrations.

13. The electro-photographic press print system of claim 1, wherein the electro-photographic press engine is selected from a dry electro-photographic press print engine and a liquid electro-photographic press print engine.

14. The electro-photographic press print system of claim 1, further comprising:

a second pre-print ink-jet system positioned after the electro-photographic press engine; and a second electro-photographic press engine positioned after the second pre-print ink-jet system.

15. The electro-photographic press print system of claim 14, wherein the pre-print ink-jet system includes a first ink-jet printhead for disposing the first fluid on a first side of a substrate, wherein the second pre-print ink-jet system includes a second ink-jet printhead for disposing a second fluid onto predefined areas of the previously printed image on the first side of the substrate.

16. The electro-photographic press print system of claim 14, further comprising:

a post-print ink-jet system positioned after the electro-photographic press engine, wherein the post-print ink-jet system includes at least one ink-jet printhead that includes a third fluid.

17. The electro-photographic press print system of claim 1, wherein the electro-photographic press engine is selected from a dry electro-photographic press print engine and a liquid electro-photographic press print engine.

18. A method of disposing a fluid onto a substrate in an electro-photographic press print system, comprising:

providing a substrate;

feeding the substrate into a pre-print ink-jet system, wherein the pre-print ink-jet system includes at least one ink-jet printhead, wherein the ink-jet printhead includes the first fluid;

disposing a first fluid onto the substrate;

feeding the substrate into an electro-photographic press print engine; and printing onto the substrate using the electro-photographic press print engine.

19. The method of claim 18, further comprising:

feeding the substrate into a post-print ink-jet system from the electro-photographic press print engine; and disposing a second fluid onto the substrate.

20. The method of claim 19, wherein the post-print ink-jet system includes at least one ink-jet printhead, wherein the ink-jet printhead includes the second fluid.

21. The method of claim 19, wherein disposing a second fluid onto the substrate includes: disposing the second fluid onto the top side of the substrate and disposing the second fluid onto the bottom side of the substrate.

22. The method of claim 19, wherein the second fluid is selected from a varnish solution and an overcoat solution.

23. The method of claim 19, wherein disposing a second fluid onto the substrate includes: disposing the second fluid onto select portions of the substrate.

24. The method of claim 23, wherein disposing a second fluid onto the substrate includes: disposing the second fluid of a first concentration on a first portion of the substrate and disposing the second fluid of a second concentration on a second portion of the substrate.

25. The method of claim 19, wherein disposing a second fluid onto the substrate includes: disposing the second fluid onto the entire surface of the substrate.

26. The method of claim 19, wherein disposing a first fluid onto the substrate includes: disposing the first fluid onto the top side of the substrate; wherein disposing a second fluid onto the substrate includes: disposing the second fluid onto select portions of the top side of the substrate; and printing onto the select portions of the top side of the substrate using a second electro-photographic press print engine.

27. The method of claim 19, further comprising:

selecting a grey level pattern, where the grams per square meter (GSM) of the second fluid disposed on the substrate corresponds to the grey level pattern selected.

28. The method of claim 18, wherein the electro-photographic press engine is selected from a dry electro-photographic press print engine and a liquid electro-photographic press print engine.

29. The method of claim 18, wherein disposing a first fluid onto the substrate includes: disposing the first fluid onto the top side of the substrate and disposing the first fluid onto the bottom side of the substrate.

30. The method of claim 18, wherein the first fluid includes a primer.

31. The method of claim 18, wherein disposing a first fluid onto the substrate includes: disposing the first fluid onto select portions of the substrate.

32. The method of claim 31, wherein disposing includes: disposing the first fluid onto select portions of the substrate that are going to be immediately printed thereon by the electro-photographic press print engine.

33. The method of claim 31, wherein disposing a first fluid onto the substrate includes: disposing the first fluid of a first concentration on a first portion of the substrate and disposing the first fluid of a second concentration on a second portion of the substrate.

34. The method of claim 18, wherein disposing a first fluid onto the substrate includes: disposing the first fluid onto the entire surface of the substrate.

35. The method of claim 18, wherein disposing a first fluid onto the substrate includes: disposing the first fluid onto the substrate based on the width of the substrate.

36. The method of claim 18, further comprising:

selecting a grey level pattern, where the grams per square meter (GSM) of the first fluid disposed on the substrate corresponds to the grey level pattern selected.

37. The method of claim 18, further comprising:

disposing a third fluid on the substrate, wherein third fluid is disposed on the side opposite of the first fluid, wherein the first fluid and the second fluid are different fluids.

38. An electro-photographic ink primer, comprising:

an adhesion promoting compound, wherein the adhesion promoter compounds is a polymeric compound; and a solvent;

wherein the primer has a pH of about 7 to 10.

39. The electro-photographic ink primer of claim 38, wherein the polymeric compound is a polyethylenimine polymer.

40. The electrophotographic ink primer of claim 39, wherein the polyethylenimine polymer has a weight-averaged molecular weight of about 25,000 to 700,000.

41. The electro-photographic ink primer of claim 38, wherein the polymeric compound is selected from polyethylene-co-acrylic acid polymer thermoplastic polyamide, amine terminated polyamide, methylated polyethylenimine polymer, and combinations thereof.

42. The electro-photographic ink primer of claim 38, wherein the solvent is selected from: 1,2-butanediol, 1,2-pentanediol, 1,2-hexanediol, 1,2,3-hexanetriol, 1,2-heptanediol, 1,2-octanediol, and combinations thereof.

43. The electro-photographic ink primer of claim 38, wherein the solvent is 1,2-hexanediol.

44. The electro-photographic ink primer of claim 38, further comprising a surfactant selected from anionic surfactants, non-ionic surfactants, zwitterionic surfactants, and cationic surfactants.

45. An electro-photographic press print system comprising:

a pre-print ink-jet system that includes at least one ink-jet printhead, wherein the ink-jet printhead includes a first fluid, wherein the first fluid includes a primer; and an electro-photographic press engine positioned after the pre-print ink-jet system.

46. The electro-photographic press print system of claim 45, further comprising:

a post-print ink-jet system positioned after the electro-photographic press engine, wherein the post-print ink-jet system includes at least one ink-jet printhead that includes a second fluid.

47. The electro-photographic press print system of claim 46, wherein the second fluid is selected from a varnish solution and an overcoat solution.

48. The electro-photographic press print system of claim 46, wherein post-print ink-jet system includes a first ink-jet printhead for disposing the third fluid on a first side of a substrate, and a second ink-jet printhead for disposing the third fluid on a second side of the substrate.

49. The electro-photographic press print system of claim 48, wherein the first ink-jet printhead includes a fourth fluid, wherein the third fluid and the fourth fluid are different fluids.

50. The electro-photographic press print system of claim 48, wherein the first ink-jet printhead includes a fourth fluid, wherein the third fluid and the fourth fluid are the same type of fluids, and wherein the third fluid and the fourth fluid are at different concentrations.

51. The electro-photographic press print system of claim 45, wherein the pre-print ink-jet system includes a first ink-jet printhead for disposing the first fluid on a first side of a substrate, and a second ink-jet printhead for disposing the first fluid on a second side of the substrate.

52. The electro-photographic press print system of claim 51, wherein the first ink-jet printhead includes a second fluid, wherein the second fluid and the first fluid are different fluids.

53. The electro-photographic press print system of claim 51, wherein the first ink-jet printhead includes a second fluid, wherein the second fluid and the first fluid are the same type of fluids, and wherein the second fluid and the first fluid are at different concentrations.

54. The electro-photographic press print system of claim 51, wherein pre-print ink-jet system includes a first drying system positioned after the first ink-jet printhead for drying the first side of the substrate, and a second drying system positioned after the second ink-jet printhead for drying the second fluid on the second side of the substrate.

55. The electro-photographic press print system of claim 54, wherein post-print ink-jet system includes a first drying system positioned after the first ink-jet printhead for drying the first side of the substrate, and a second drying system positioned after the second ink-jet printhead for drying the second fluid on the second side of the substrate.

56. The electro-photographic press print system of claim 51, wherein the first ink-jet printhead includes a first primer solution and a second primer solution in separate compartments, wherein the second ink-jet printhead includes the first primer solution and the second primer solution in separate compartments, wherein the first primer solution has a first concentration and the second primer has a second concentration, wherein the first concentration and the second concentration are different.

57. The electro-photographic press print system of claim 45, further comprising:

a second pre-print ink-jet system positioned after the first electro-photographic press engine; and a second electro-photographic press engine positioned after the second pre-print ink-jet system.

58. The electro-photographic press print system of claim 57, wherein the pre-print ink-jet system includes a first ink-jet printhead for disposing the first fluid on a first side of a substrate, wherein the second pre-print ink-jet system includes a second ink-jet printhead for disposing a second fluid onto predefined areas of the previously printed image on the first side of the substrate.

59. The electro-photographic press print system of claim 57, further comprising:

a post-print ink-jet system positioned after the electro-photographic press engine, wherein the post-print ink-jet system includes at least one ink-jet printhead that includes a third fluid.

60. A method of disposing a fluid onto a substrate in an electro-photographic press print system comprising:

providing a substrate;

feeding the substrate into a pre-print ink-jet system;

disposing a first fluid onto the substrate, wherein the first fluid includes a primer;

feeding the substrate into an electro-photographic press print engine; and printing onto the substrate using the electro-photographic press print engine.

61. The method of claim 60, wherein the pre-print ink-jet system includes at least one ink-jet printhead, wherein the ink-jet printhead includes the first fluid.

62. The method of claim 60, further comprising:

feeding the substrate into a post-print ink-jet system from the electro-photographic press print engine; and disposing a second fluid onto the substrate.

63. The method of claim 62, wherein the post-print ink-jet system includes at least one ink-jet printhead, wherein the ink-jet printhead includes the second fluid.

64. The method of claim 62, wherein disposing a second fluid onto the substrate includes: disposing the second fluid onto the top side of the substrate and disposing the second fluid onto the bottom side of the substrate.

65. The method of claim 60, wherein the second fluid is selected from a varnish solution and an overcoat solution.

66. The method of claim 62, wherein disposing a second fluid onto the substrate includes: disposing the second fluid onto select portions of the substrate.

67. The method of claim 66, wherein disposing a second fluid onto the substrate includes: disposing the second fluid of a first concentration on a first portion of the substrate and disposing the second fluid of a second concentration on a second portion of the substrate.

68. The method of claim 62, further comprising: selecting a grey level pattern, where the grams per square meter (GSM) of the second fluid disposed on the substrate corresponds to the grey level pattern selected.

69. The method of claim 60, wherein the electro-photographic press engine is selected from a dry electro-photographic press print engine and a liquid electro-photographic press print engine.

70. The method of claim 60, wherein disposing a first fluid onto the substrate includes: disposing the first fluid onto the top side of the substrate and disposing the first fluid onto the bottom side of the substrate.

71. The method of claim 60, wherein disposing a first fluid onto the substrate includes: disposing the first fluid onto select portions of the substrate.

72. The method of claim 71, wherein disposing includes: disposing the first fluid onto select portions of the substrate that are going to be immediately printed thereon by the electro-photographic press print engine.

73. The method of claim 71, wherein disposing a first fluid onto the substrate includes: disposing the first fluid of a first concentration on a first portion of the substrate and disposing the first fluid of a second concentration on a second portion of the substrate.

74. The method of claim 60, wherein disposing a first fluid onto the substrate includes: disposing the first fluid onto the entire surface of the substrate.

75. The method of claim 60, wherein disposing a first fluid onto the substrate includes: disposing the first fluid onto the substrate based on the width of the substrate.

76. The method of claim 60, wherein disposing a second fluid onto the substrate includes: disposing the second fluid onto the entire surface of the substrate.

77. The method of claim 60, wherein disposing a first fluid onto the substrate includes: disposing the first fluid onto the top side of the substrate; wherein disposing a second fluid onto the substrate includes: disposing the second fluid onto select portions of the top side of the substrate; and printing onto the select portions of the top side of the substrate using a second electro-photographic press print engine.

78. The method of claim 60, further comprising: selecting a grey level pattern, where the grams per square meter (GSM) of the first fluid disposed on the substrate corresponds to the grey level pattern selected.

79. The method of claim 60, further comprising: disposing a third fluid on the substrate, wherein third fluid is disposed on the side opposite of the first fluid, wherein the first fluid and the second fluid are different fluids.

* * * * *

UNITED STATES PATENT AND TRADEMARK OFFICE

CERTIFICATE OF CORRECTION

PATENT NO. : 7,796,145 B2
APPLICATION NO. : 11/786408
DATED : September 14, 2010
INVENTOR(S) : Yaacov Almog et al.

It is certified that error appears in the above-identified patent and that said Letters Patent is hereby corrected as shown below:

In the drawings, Sheet 1, Figure 1, delete "SUBTRATE", and insert --SUBSTRATE,--.

In the drawings, Sheet 4, Figure 5, delete "SUBTRATE", and insert -- SUBSTRATE, --.

In column 11, line 37, in Claim 1, delete "system," and insert -- system --, therefor.

In column 12, line 60, in Claim 18, delete "system," and insert -- system --, therefor.

In column 14, line 12, in Claim 38, delete "solvent;" and insert -- solvent, --, therefor.

In column 16, line 8, in Claim 65, delete "claim 60," and insert -- claim 62, --, therefor.

Signed and Sealed this
Nineteenth Day of April, 2011

David J. Kappos

David J. Kappos
*Director of the United States Patent and Trademark Office*